US008827114B2

(12) United States Patent
Scott

(10) Patent No.: US 8,827,114 B2
(45) Date of Patent: Sep. 9, 2014

(54) APPARATUS, SYSTEM, AND METHOD FOR CONTAINING A FLUID

(76) Inventor: Edwin Scott, Cedar Hills, UT (US)

( * ) Notice: Subject to any disclaimer, the term of this patent is extended or adjusted under 35 U.S.C. 154(b) by 779 days.

(21) Appl. No.: 12/691,857

(22) Filed: Jan. 22, 2010

(65) Prior Publication Data

US 2011/0182533 A1 Jul. 28, 2011

(51) Int. Cl.
*B65D 35/14* (2006.01)
*B65D 83/00* (2006.01)
*B65D 35/32* (2006.01)

(52) U.S. Cl.
CPC ..... *B65D 83/0055* (2013.01); *B65D 35/32* (2013.01); *B65D 35/14* (2013.01)
USPC ..... 222/94; 222/99; 222/105; 222/113; 383/119

(58) Field of Classification Search
CPC ..... B65D 75/008; B65D 35/14; B65D 35/32; B65D 88/1625
USPC ..... 222/99–109, 174, 180, 182, 113, 94; 206/531, 538, 69, 442, 443, 481, 490; 220/17.2, 17.3, 9.4; 383/119, 26, 27, 383/104, 113
See application file for complete search history.

(56) References Cited

U.S. PATENT DOCUMENTS 1,039,044 A * 9/1912 Furhman ..... 383/29
1,041,758 A * 10/1912 Ellis ..... 383/24
1,202,085 A * 10/1916 Mitchell ..... 383/33
1,225,511 A * 5/1917 Sexton ..... 383/29
1,375,070 A * 4/1921 Wheildon ..... 383/15
1,447,981 A * 3/1923 Henderson ..... 383/25
1,521,184 A * 12/1924 Holton ..... 383/25
1,580,705 A * 4/1926 Wittmann ..... 383/85
1,661,400 A * 3/1928 Yehle ..... 141/18
1,670,709 A * 5/1928 Blood ..... 383/33
2,031,197 A * 2/1936 Weaver ..... 607/112
2,672,258 A * 3/1954 Marberg ..... 222/100
2,880,911 A 4/1959 Robertson
3,144,976 A * 8/1964 Freshour ..... 206/229
3,203,596 A 8/1965 Davidson
3,401,837 A * 9/1968 Wiedeman ..... 222/99
3,434,652 A * 3/1969 Shore ..... 383/104
3,464,594 A 9/1969 Forman
3,576,987 A * 5/1971 Voight et al. ..... 362/34
3,589,506 A 6/1971 Ford et al.
4,316,556 A 2/1982 Ferrari
4,350,712 A 9/1982 Kocharian et al.
4,452,823 A 6/1984 Connolly et al.
4,579,254 A 4/1986 Puskarcik
4,640,328 A * 2/1987 Arney ..... 220/9.1

(Continued)

*Primary Examiner* — Daniel R Shearer
(74) *Attorney, Agent, or Firm* — Kunzler Law Group

(57) ABSTRACT

An apparatus, system, and method are disclosed for containing and dispensing a fluid. The apparatus includes a fluid receiving sleeve made of a pliable material having a structural integrity that may be overcome by a weight of a fluid when the fluid is located within the fluid receiving sleeve. A support member comprising a substantially rigid rod, having a structural integrity sufficient to support the pliable material of the fluid receiving sleeve, supports the fluid receiving sleeve along the sidewall of the fluid receiving sleeve when the support member is positioned in an engaged position. A support member coupling couples the fluid receiving sleeve with the support member along the sidewall of the fluid receiving sleeve when the support member is positioned in an engaged position. In this manner the support member maintains the structural integrity of the fluid receiving sleeve.

20 Claims, 10 Drawing Sheets

(56) References Cited

U.S. PATENT DOCUMENTS

| | | | | | |
|---|---|---|---|---|---|
| 4,664,293 | A | | 5/1987 | Sheppard | |
| 4,729,496 | A | | 3/1988 | Davidson | |
| 4,817,823 | A | | 4/1989 | Sparr, Sr. | |
| 4,898,280 | A | * | 2/1990 | Runge | 383/200 |
| 4,928,851 | A | | 5/1990 | Eatherly | |
| 4,978,025 | A | * | 12/1990 | Fougeres | 222/105 |
| 4,997,107 | A | | 3/1991 | Snyder et al. | |
| 5,025,925 | A | * | 6/1991 | Wiklund | 206/386 |
| 5,167,348 | A | | 12/1992 | Okami et al. | |
| 5,322,193 | A | | 6/1994 | Sunderland | |
| 5,437,384 | A | * | 8/1995 | Farrell | 220/1.5 |
| D363,194 | S | | 10/1995 | Murphy | |
| 5,467,897 | A | | 11/1995 | Williams | |
| 6,258,384 | B1 | | 7/2001 | Stanley et al. | |
| 6,287,003 | B1 | * | 9/2001 | Hafer | 383/119 |
| 6,561,385 | B1 | | 5/2003 | Jacobs | |
| 6,659,619 | B2 | * | 12/2003 | Gordon | 362/109 |
| 6,685,057 | B1 | | 2/2004 | Sullivan | |
| 6,955,443 | B2 | * | 10/2005 | Solowiej | 362/101 |
| 7,073,917 | B2 | * | 7/2006 | VanderSchuit | 362/96 |
| 7,159,742 | B2 | * | 1/2007 | Lee | 222/92 |
| 7,422,339 | B2 | * | 9/2008 | Jordan | 362/34 |
| 7,427,160 | B2 | * | 9/2008 | Richardson et al. | 383/16 |
| 2001/0046545 | A1 | | 11/2001 | Jones | |
| 2003/0219517 | A1 | | 11/2003 | Purcell | |
| 2004/0219265 | A1 | | 11/2004 | Purcell | |
| 2005/0142253 | A1 | | 6/2005 | Purcell | |
| 2005/0281933 | A1 | | 12/2005 | Squicciarini | |
| 2007/0286929 | A1 | | 12/2007 | Andersen | |
| 2008/0226777 | A1 | | 9/2008 | Helfend et al. | |

* cited by examiner

APPARATUS, SYSTEM, AND METHOD FOR CONTAINING A FLUID

BACKGROUND

1. Field

This invention relates to fluid containers made of a pliable material and more particularly relates to an apparatus, system and method for enhancing the structural integrity of a fluid container made of a pliable material to avoid a collapse of the material comprising the fluid container.

2. Description of the Related Art

Fluid containers made of pliable materials are used to contain a variety of liquids for personal consumption. For example certain artificially and naturally flavored juices are packaged in a pliable pouch made of a flexible plastic material. Each pliable pouch contains about six to seven fluid ounces of juice, enough juice to quench an average user's thirst.

Other consumable products are packaged in pliable containers. For example, certain frozen snack foods are packaged in a pliable plastic tube. The pliable tube is filled with a flavored sugary liquid and is sealed at each end. After the flavored liquid is frozen a user can cut off the top and eat the frozen snack out of the top of the tube, like a Popsicle without a stick. Many other fluid materials are packaged in pliable plastic tubes such as single shot energy supplements or drinks, yogurt, powdered substances for mixing with water or other liquids, or other edible items.

Pliable containers are not limited to edible materials. For example, pastes and lotions for dermatological uses are often contained within sealed pliable containers. Similarly, glues and other viscous materials are often sold in flexible or pliable containers.

Pliable containers for containing liquids provide several advantages over rigid containers. First, in terms of disposal the flexible material of a pliable container allows the pliable container to be easily flattened before disposing of the container. Additionally, a pliable container may use less material than a rigid container. Manufacturing processes for creating a pliable container may also be more economically efficient than the plastic molding techniques used in creating rigid containers.

Despite the advantages associated with pliable containers, there use is limited to applications where the structural integrity of the container is not an issue. When a pliable container is used to contain an edible product certain precautions are typically taken to avoid spilling the contents of the container on the user. For example, when a pliable container is used to contain an artificial or naturally flavored juice, a straw is provided to consume the juice.

In the frozen snack food example the structural integrity of the pliable container is not an issue as long as the material within the container remains frozen. However, once the material within the container thaws, the user risks spilling the material from the container if the container folds or bends due to the weight of the material in the container.

Many of the edible items sold in pliable containers, such as the frozen snack food or the natural or artificially flavored juice, are directed at children. Often marketers of products aimed at children include gifts or other novelty features in the packaging of a product to encourage children to request the product. For example, children's cereal often includes a surprise in the cereal. Similarly, the packaging of the children's cereal often includes games, comics, or other novelty features. Generally, the gift or novelty item adds nothing of value to the actual product or packaging and is simply used as marketing tool.

SUMMARY

From the foregoing discussion, it should be apparent that a need exists for an apparatus, system, and method that enhances the structural integrity of a fluid container made of a pliable material to avoid a collapse of the material comprising the fluid container. Beneficially, such an apparatus, system, and method would incorporate a novelty feature into the packaging.

The present invention has been developed in response to the present state of the art, and in particular, in response to the problems and needs in the art that have not yet been fully solved by currently available liquid containers made of pliable materials. Accordingly, the present invention has been developed to provide an apparatus, system, and method for containing a liquid that overcome many or all of the above-discussed shortcomings in the art.

The apparatus to contain a fluid is provided with a fluid receiving sleeve, a support member and a support member coupling. The fluid receiving sleeve is made of a pliable material having a structural integrity that may be overcome by a weight of a fluid when the fluid is located within the fluid receiving sleeve. In certain embodiments the fluid receiving sleeve includes a sidewall, a dispensing end, and a sealed end. The sealed end of the fluid receiving sleeve includes a liquid tight seal that keeps a fluid dispensed within the fluid receiving retained within the fluid receiving sleeve.

The support member is a substantially rigid rod for supporting the fluid receiving sleeve along the sidewall of the fluid receiving sleeve between the dispensing end and the sealed end. The substantially rigid rod is made of a material having a structural integrity sufficient to support the pliable material of the fluid receiving sleeve when the fluid receiving sleeve contains a fluid.

The support member coupling is configured to receive a support member to couple the support member to the fluid receiving sleeve when the support member is positioned in an engaged position within the support member coupling. In the engaged position the support member is removably coupled to the fluid receiving sleeve along the sidewall of the fluid receiving sleeve. The support member supports the fluid receiving sleeve when the support member is positioned in the engaged position. In this manner the structural integrity of the fluid receiving sleeve is maintained by the support member.

The support member, in one embodiment, is a support member receiving sleeve. The support member receiving sleeve is positioned next to the sidewall of the fluid receiving sleeve and is attached to the sidewall of the fluid receiving sleeve and separated from the fluid receiving sleeve by a seal. The support member receiving sleeve receives the support member within the support member receiving sleeve to couple the support member to the fluid receiving sleeve.

In certain embodiments the support member receiving sleeve includes a support member sidewall, a support member receiving end, and a support member sealed end. The support member sidewall has a length substantially a same length as the sidewall of the fluid receiving sleeve. In an exemplary embodiment the support member sidewall of the support member receiving sleeve is attached to the sidewall of the fluid receiving sleeve along the entire length of the sidewall of the fluid receiving sleeve.

In a further embodiment, the support member coupling is a plurality of retention sheaths attached to the sidewall of the fluid receiving sleeve at attachment points along the sidewall of the fluid receiving sleeve. The plurality of retention sheaths receive the support member. In such an embodiment the support member supports the fluid receiving sleeve at the attachment points on the sidewall of the fluid receiving sleeve.

In another embodiment, the support member is a hollow tube having a length sufficient to substantially span a length of the fluid receiving sleeve between the dispensing end and the sealed end. The hollow tube includes a slot along the length of the hollow tube. The slot in the hollow tube receives a portion of the sidewall of the fluid receiving sleeve to attach the hollow tube to the sidewall of the fluid receiving sleeve.

In one embodiment, the apparatus includes a rolling sleeve attached perpendicular to the fluid receiving sleeve. The rolling sleeve receives a rolling member to assists a user in rolling the fluid receiving sleeve to dispense a fluid contained within the fluid receiving sleeve. The rolling member may be a separate item or, in certain embodiments, the rolling member may be the support member removed from the support member coupling.

The apparatus, in one embodiment, includes a translucent fluid contained within the fluid receiving sleeve. In certain embodiments the support member may illuminate the translucent fluid disposed within the fluid receiving sleeve. In such an embodiment, the support member may be a single use translucent plastic tube containing isolated substances which when combined illuminate through a chemical reaction induced chemiluminescence. In another embodiment, the support member includes a power source and a light emitting diode. The power source is electronically coupled to the light emitting diode to illuminate the support member. The illuminated support member illuminates the translucent fluid contained within the fluid receiving sleeve.

Another embodiment of an apparatus to contain a fluid includes a pliable tube separated into a fluid receiving sleeve, a support member receiving sleeve, and a rolling sleeve. The fluid receiving sleeve is made of a pliable material having a structural integrity that may be overcome by a weight of a fluid when the fluid is disposed within the fluid receiving sleeve. The fluid receiving sleeve includes a sidewall, a dispensing end, and a sealed end. The sealed end has a liquid tight seal that keeps a fluid contained within the fluid receiving sleeve when fluid is placed within the fluid receiving sleeve.

The support member receiving sleeve is positioned next to the fluid receiving sleeve and is attached to and separated from the sidewall of the fluid receiving sleeve by a liquid tight seal. The support member receiving sleeve receives to receive a support member within the support member receiving sleeve.

The rolling sleeve is positioned perpendicular to the fluid receiving sleeve and the support member receiving sleeve. The rolling sleeve is configured to receive a rolling member to assists a user in rolling the fluid receiving sleeve to dispense a fluid contained within the fluid receiving sleeve.

In certain embodiments, the apparatus also includes a support member removably received within the support member receiving sleeve. The support member is a substantially rigid rod for supporting the fluid receiving sleeve along a length of the sidewall of the fluid receiving sleeve between the dispensing end and the sealed end. The substantially rigid rod is made of a material having a structural integrity sufficient to support the pliable material of the fluid receiving sleeve when a fluid is disposed within the fluid receiving sleeve and when the support member is positioned in an engaged position. In the engaged position the support member is received within the support member receiving sleeve. The support member supports the fluid receiving sleeve when the support member is positioned in the engaged position so that the structural integrity of the fluid receiving sleeve is maintained and so that any fluid contained within the fluid receiving sleeve does not spill from the fluid receiving sleeve.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided for a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
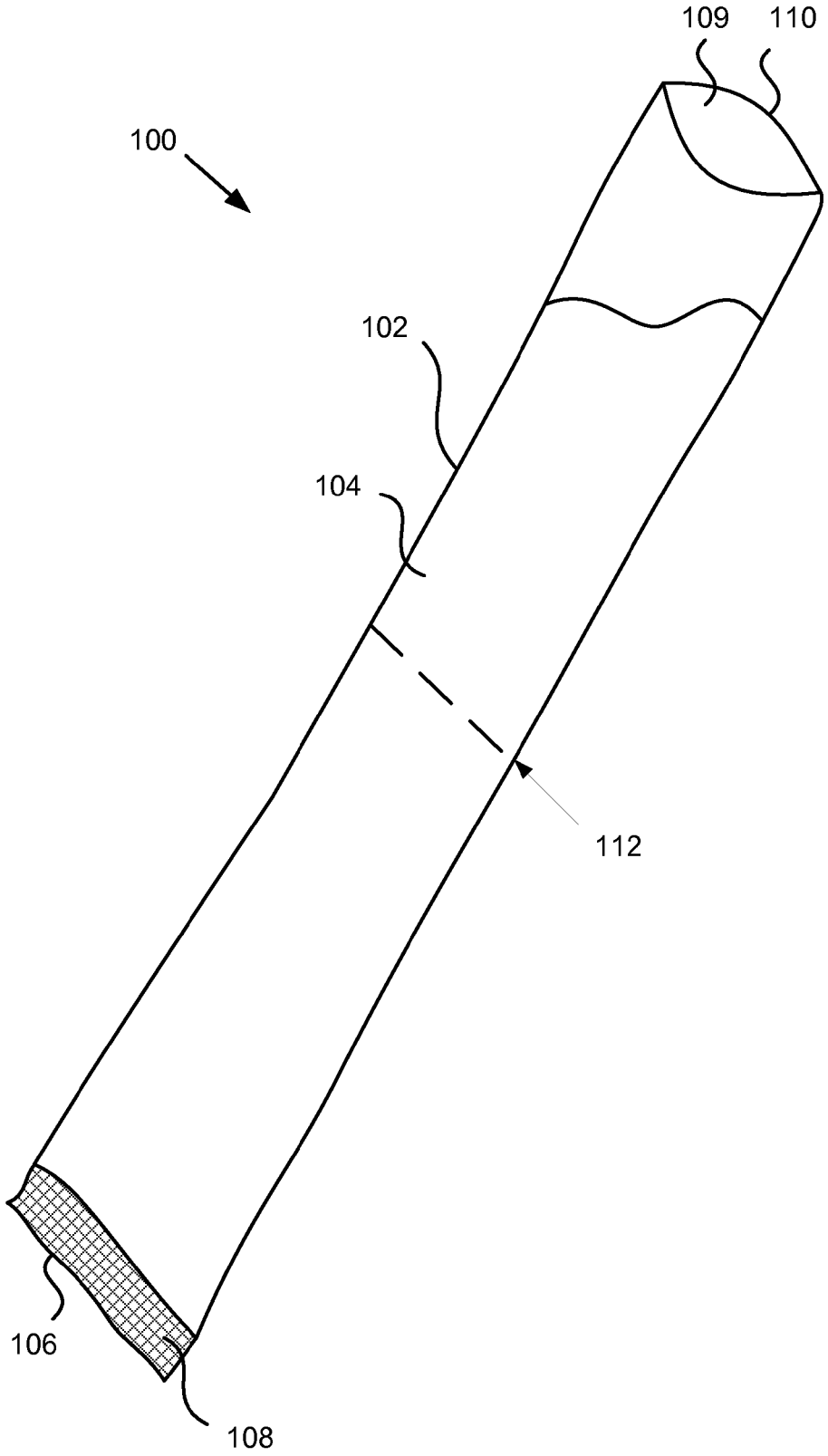
FIG. 1 (Prior Art)
FIG. 1 is a perspective view illustrating one embodiment of a prior art fluid container.

FIG. 1 depicts a prior art fluid containing and dispensing apparatus 100. The prior art apparatus 100 includes a pliable tube 102 having a structural integrity that may be overcome by a fluid 104 dispensed within the pliable tube. Ordinarily the bottom end 106 of the pliable tube 102 is sealed by a seal 108. The seal 108 creates a liquid tight barrier beyond which the liquid 104 disposed within the pliable tube 102 cannot pass. The fluid 104 is maintained within the pliable tube 102 by another seal (not shown) located at the top end 110 of the pliable tube 102 which creates another liquid tight barrier at the top end 110 of the pliable tube 102. When a user wishes to consume or use the liquid contained within the pliable tube 102, the user removes the seal (not shown) at the top end 110 of the pliable tube 102. The embodiment illustrated in FIG. 1 shows the pliable tube 102 having the seal at the top end 110 removed. The fluid 104 contained within the pliable tube 102 can be removed through opening 109.

Examples of fluids 104 contained within prior art fluid containing and dispensing apparatus' 100 include flavored water, single shot energy supplements or drinks, yogurt, or other edible items. In certain embodiments a similar pliable tube 102 is used to contain premeasured powdered substances for mixing with water or other liquid. As used herein, the term "fluid" is defined as any substance which is capable of flowing. Thus, fluids discussed herein are not limited to liquid fluids. Additionally, the term "fluid" includes frozen substances which, while not capable of flowing in the frozen form, are capable of flowing in a thawed form.

Fluids 104 contained within the pliable tube 102 typically have a mass that can overcome the structural integrity of the pliable tube 102 causing the pliable tube to bend under the weight of the fluid 104. Depending on where the user is holding the pliable tube 102, the pliable tube can fold and empty any fluid 104 that is contained within the pliable tube 102 above the point of the fold. For example, if a user holds the pliable tube 102 at point 112 the weight of the fluid 104 contained above point 112 may cause the pliable tube 102 to fold at point 112. Any fluid 104 contained within the pliable tube 102 between point 112 and the top end 110 of the pliable tube 102 may then spill from the opening 109 in the pliable tube 102. One of skill in the art will recognize that the point at which the pliable tube bends or folds may not be a static position and is dependent on several factors such as the weight of the fluid 104 contained within the pliable tube 102, the state of the fluid 104 (solid, semisolid, liquid, etc.), and the rigidity of the material that makes up the pliable tube 102. Thus, the folding point 112 may be may be at different positions along the length of the pliable tube 102 depending on the above stated factors as well as others.

Figure 2:
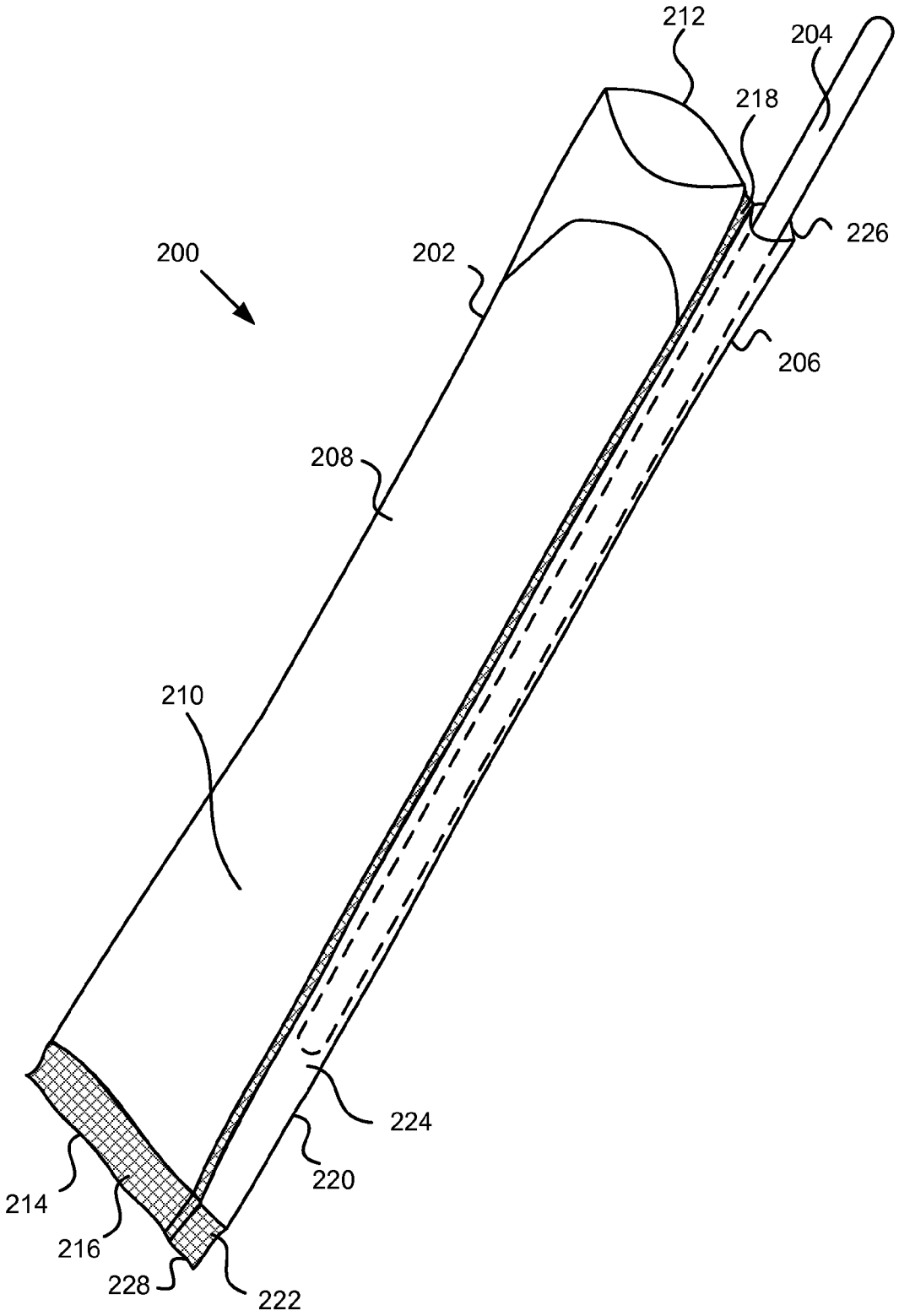
FIG. 2 is a perspective view illustrating one embodiment of a fluid container including a support member and a support member coupling in accordance with the present invention.

FIG. 2 illustrates an apparatus 200 for containing a fluid according to one embodiment of the present invention. In certain embodiments the apparatus 200 includes a fluid receiving sleeve 202, a support member 204, and a support member coupling 206.

In the embodiment illustrated in FIG. 2 the fluid receiving sleeve 202 may be made of a pliable material such as a plastic or a rubber material. A fluid 208 contained within the fluid receiving sleeve 202 may have a mass that can overcome the structural integrity of the pliable material that makes up the fluid receiving sleeve 202 causing the fluid receiving sleeve 202 to bend under the weight of the fluid 208. As with FIG. 1, examples of fluids 208 used with embodiments of the present invention include flavored water, single shot energy supplements or drinks, yogurt, or other edible items. In certain embodiments the fluid receiving sleeve 202 may be used to contain premeasured powdered substances for mixing with water or other liquids. One of skill in the art will recognize that the fluid 208 contained within the fluid receiving sleeve 202 may be in a solid, semisolid, liquid, or gaseous state.

The fluid receiving sleeve 202 includes a sidewall 210, a dispensing end 212, and a sealed end 214. In certain embodiments the dispensing end 212 and the sealed end 214 may be about the same length and the length of the sidewall 210 may be substantially longer than the length of the dispensing end 212 and the sealed end 214. For example, in an exemplary embodiment the length of the dispensing end 212 may be in the range of about one inch to about two inches, the length of the sealed end 214 may be in the range of about one inch to about two inches, and the length of the sidewall 210 may be in the range of about nine and one half inches to about eleven and one half inches. In another exemplary embodiment the length of the dispensing end 212 may be in the range of about one inch to about two inches, the length of the sealed end 214 may be in the range of about one inch to about two inches, and the length of the sidewall 210 may be in the range of about eighteen inches to about twenty inches. Of course, one of skill in the art will recognize that these are exemplary measurements only. Therefore, the dimensions of the fluid receiving sleeve 202 may vary without departing from essential spirit of the present invention.

In certain embodiments the fluid receiving sleeve 202 may be sized to receive a premeasured amount of a substance such as a premeasured medication. In one embodiment the fluid receiving sleeve 202 may be sized to receive a premeasured amount of liquor mixed in a flavored mixer. The premeasured amount of liquor may be measured according to local or federal laws or regulations regarding dispensing liquor.

In certain embodiments the sealed end 214 of the fluid receiving sleeve 202 may have a length that is shorter than the length of the dispensing end 212 such that the apparatus 200 is V shaped when the apparatus 200 is viewed with the dispensing end 212 at the top of the apparatus 200. In another embodiment the sealed end 214 of the fluid receiving sleeve 202 may have a length that is longer than the length of the dispensing end 212 such that the apparatus 200 has an inverse V shape when the apparatus 200 is viewed with the dispensing end 212 at the top of the apparatus 200.

The sealed end 214 of the fluid receiving sleeve 202 includes a seal 216 for retaining the fluid 208 within the fluid receiving sleeve 202. In certain embodiments the seal 216 of the sealed end 214 may be accomplished through use of glues or other sealing substances injected or inserted into the fluid receiving sleeve 202. In another embodiment the seal 216 may be accomplished through plastic welding. Examples of plastic welding techniques which may be used to seal the fluid receiving sleeve include hot gas welding, speed tip welding, extrusion welding, contact welding, hot plate welding, high frequency welding, ultrasonic welding, vibration friction welding, spin welding, laser welding, solvent welding, or other plastic welding techniques.

In the embodiment illustrated in FIG. 2 the dispensing end 212 is illustrated in an open position. In an exemplary embodiment, the dispensing end 212 may also include a seal (not shown) substantially similar to the seal 216 of the sealed end 214. Thus, in one embodiment the dispensing end 212 and the sealed end 214 may be interchangeable in that both ends may be sealed. In such an embodiment, once an end is opened that end becomes the dispensing end 212 and the opposing end becomes the sealed end 214. In certain embodiments a pair of scissors, a knife, or other cutting device may be used to open the dispensing end 212 by cutting off or otherwise removing the seal (not shown) from the dispensing end 212. In certain embodiments the dispensing end 212 may include a check valve, bite valve or other valve for efficiently dispensing fluid contained within the fluid receiving sleeve 202.

The sidewall 210 of the fluid receiving sleeve 202 is made of a pliable material that may deform under a weight applied by fluid 208 contained within the fluid receiving sleeve 202. Thus, in certain embodiments a fluid 208 contained within the fluid receiving sleeve 202 may have a mass that can overcome the structural integrity of the pliable material of the sidewall 210. In one embodiment the fluid 208 contained within the fluid receiving sleeve 202 may be frozen and thus provide support to the fluid receiving sleeve as long as the fluid 208 remains frozen. Once the fluid 208 contained within the fluid receiving sleeve 202 thaws, the fluid 208 may no longer support the fluid receiving sleeve 202. Where the dispensing end 212 of the fluid receiving sleeve 202 is open, the fluid 208 may spill from the fluid receiving sleeve 202 when the weight of the fluid 208 overcomes the structural integrity of the pliable material of the sidewall 210.

In certain embodiments the sidewall 210 of the fluid receiving sleeve 202 is continuous such that the sidewall is tubular. In another embodiment, one side of the sidewall 210 may include a separating seal 218 running the length of the sidewall 210 from the sealed end 214 to the dispensing end 212. The separating seal 218 creates a liquid tight seal that separates a support member receiving sleeve 220 from the fluid receiving sleeve 202. Thus, in certain embodiments fluid 208 placed within the fluid receiving sleeve 202 is maintained within the fluid receiving sleeve 202 by the liquid tight seal 216 at the sealed end 214 and the liquid tight seal of the separating seal 218 running the length of the fluid receiving sleeve 202.

To maintain the structural integrity of the fluid receiving sleeve 202 a support member 202 is attached to the fluid receiving sleeve 202. The support member 202 is attached to the fluid receiving sleeve 202 by a support member coupling 206. In the embodiment illustrated in FIG. 2, the support member coupling 206 is a support member receiving sleeve 220 that includes a support member sleeve sidewall 224, a support member receiving end 226, and a support member sealed end 228. In certain embodiments the support member receiving end 226 and the support member sealed end 228 may be about the same length and the length of the support member sleeve sidewall 224 may be substantially longer than the length of the support member receiving end 226 and the support member sealed end 228. For example, in an exemplary embodiment the length of the support member receiving end 226 may be in the range of about one fourth of an inch to about three fourths of an inch, the length of the support member sealed end 228 may also be in the range of about one fourth of an inch to about three fourths of an inch, and the length of the support member sleeve sidewall 224 may be in the range of about nine and one half inches to about eleven and one half inches. In another exemplary embodiment the length of the support member receiving end 226 may be in the range of about one fourth of an inch to about three fourths of an inch, the length of the support member sealed end 228 may also be in the range of about one fourth of an inch to about three fourths of an inch, and the length of the support member sleeve sidewall 224 may be in the range of about eighteen inches to about twenty inches. Of course, one of skill in the art will recognize that these are exemplary measurements only. Therefore, the dimensions of the support member receiving sleeve 202 may vary without departing from essential spirit of the present invention.

The support member receiving sleeve 220 is positioned next to the sidewall 210 of the fluid receiving sleeve 202. The support member sleeve sidewall 224 of the support member receiving sleeve 206 is attached to the side wall 210 of the fluid receiving sleeve 202. As discussed above, in certain embodiments a separating seal 218 separates the sidewall 210 of the fluid receiving sleeve 202 from the support member sleeve sidewall 224 of the support member receiving sleeve 220.

The support member sealed end 228 of the support member receiving sleeve 220 may be sealed by a seal 222 at one or both ends to keep the support member 204 secure within the support member receiving sleeve 220. In certain embodiments the seal 216 at the sealed end 214 of the fluid receiving sleeve 202 may continue across the support member sealed end 228 of the support member receiving sleeve 220 to seal the end of the support member receiving sleeve 220. One of skill in the art will recognize that in certain embodiment it may be unnecessary to provide a liquid tight seal on the support member receiving sleeve 220 because in certain embodiments the support member receiving sleeve 220 may contain solid material or item such as a support member 204. Thus, in one embodiment the liquid tight seal 216 at the sealed end 214 of the fluid receiving sleeve 202 may only seal the fluid receiving sleeve 202 and a separate non-liquid-tight seal 222 may be applied to the support member receiving sleeve 220 to keep the support member 204 in the support member receiving sleeve 220.

In one embodiment the support member receiving end 226 of the support member receiving sleeve 220 may be open as illustrated in FIG. 2. In another embodiment the support member receiving end 226 of the support member receiving sleeve 220 may be sealed by a seal substantially similar to the seal 222 of the support member receiving sleeve sealed end 228. Where both ends of the support member receiving sleeve 220 are sealed, the first end to be opened becomes the receiving end 226 of the support member receiving sleeve 220. The other end of the support member receiving sleeve 220 then becomes the sealed end 228 of the support member receiving sleeve 220. In certain embodiments both ends of the support member receiving sleeve 220 may be left open such that the support member receiving sleeve has two receiving ends 226 and no sealed end 228.

The support member 204 is slideable within the support member receiving sleeve 220 such that the support member 204 can be withdrawn from the support member receiving sleeve 220 in a disengaged position or inserted all the way into the support member receiving sleeve 220 in an engaged position. In certain embodiments the support member 204 may be considered to be in an engaged position when the support member 204 is inserted far enough into the support member receiving sleeve 220 that the support member 204 provides support to at least one half of the fluid receiving sleeve 202. In other embodiments the support member 204 may support only a portion of the fluid receiving sleeve 202 in the engaged position.

In one embodiment, the support member receiving sleeve 220 has a length that is about the same as a length of the fluid receiving sleeve 202. In such an embodiment the support member 204 may also have a length that is about the same length as the support member receiving sleeve 220 and the fluid receiving sleeve 202. In an exemplary embodiment, the support member 204 is a substantially rigid rod having a length in a range of about seven to about nine inches and a diameter of about one eighth of an inch to about three sixteenths of an inch. Of course, one of skill in the art will recognize that these are exemplary measurements only and that the dimensions of the support member 204 may vary without departing from essential spirit of the present invention. In one embodiment the support member receiving sleeve 220 couples the support member 204 to the fluid receiving sleeve 202 along substantially the entire length of the sidewall 210 of the fluid receiving sleeve 202 providing support to the fluid receiving sleeve 202 along substantially the entire length of the fluid receiving sleeve 202.

The support member 204 is made of a rigid material having a structural integrity sufficient to support the fluid receiving sleeve 202 when the fluid receiving sleeve contains a fluid 208 having a mass sufficient to overcome the structural integrity of the fluid receiving sleeve. In certain embodiments the support member 204 is a substantially rigid rod having a structural integrity sufficient to support the pliable material of the fluid receiving sleeve 202 when a fluid 208 is disposed within the fluid receiving sleeve 202.

Figure 3:
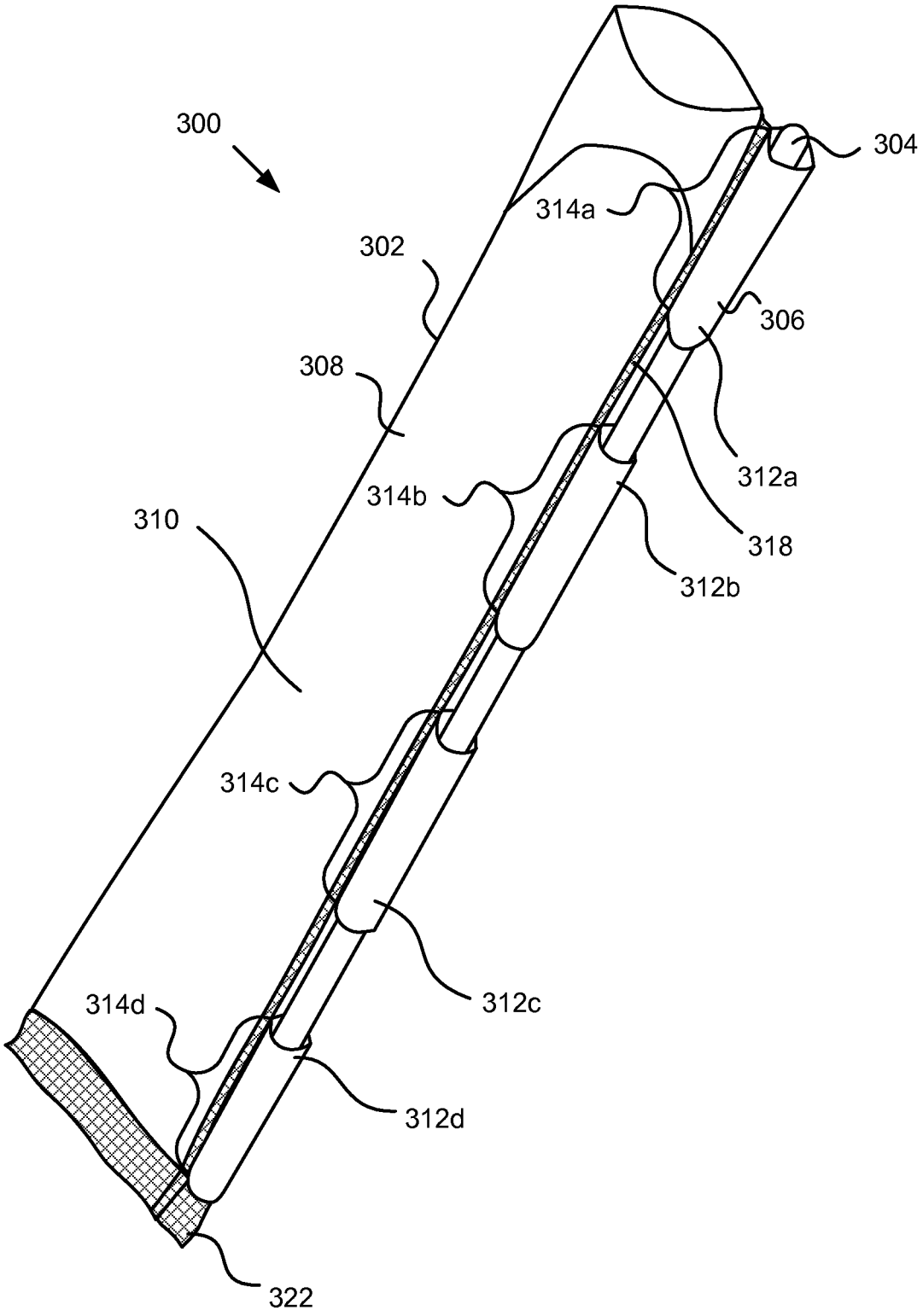
FIG. 3 is a perspective view illustrating one embodiment of a fluid container including a support member coupled to a fluid receiving sleeve by a plurality of retention sheaths in accordance with the present invention.

FIG. 3 illustrates another embodiment of an apparatus 300 for containing a fluid 308. In certain embodiments the apparatus 300 includes a fluid receiving sleeve 302, a support member 304, and a support member coupling 306. In certain embodiments the fluid receiving sleeve 302 and the support member 304 are substantially similar to the fluid receiving sleeve 202 and the support member 204 discussed above in relation to FIG. 2.

In the embodiment illustrated in FIG. 3 the support member coupling 306 includes a plurality of retention sheaths 312*a*-312*d* (collectively 312) attached to a sidewall 310 of the fluid receiving sleeve 302 at a plurality of attachment points 314*a*-314*d* (collectively 314). In certain embodiments the attachment points 314 include the area under each bracket 314 which is substantially the same length as the length of each retention sheath 312. In other embodiments the attachment points 314 may have a length that is shorter than the length of the retention sheaths 312.

In one embodiment the retention sheaths 312 may attach directly to the sidewall 310 of the fluid receiving sleeve 302. In another embodiment, one side of the sidewall 310 may include a separating seal 318 and the retention sheaths 312 may be attached to the sidewall 310 of the fluid receiving sleeve 302 by the separating seal 318.

The embodiment illustrated in FIG. 3 includes four retention sheaths 312. However, the present invention is not limited to four retention sheaths 312. In certain embodiments the apparatus 300 may include only two retention sheaths 312, one at each end of the apparatus 300. In another embodiment, the apparatus 300 may include more than four retention sheaths 312. One of skill in the art will recognize that the more attachment points 314 and corresponding retention sheaths 312 that are attached to the fluid receiving sleeve 302, the more support the support member 304 provides to the fluid receiving sleeve 302.

In certain embodiments, the bottom end retention sheath 312*d* may include a seal 322 that keeps the support member 304 from passing all the way through the bottom end retention sheath 312*d*. In another embodiment the top end retention sheath 312*a* may also include a seal (not shown) that keeps the support member 304 from being removed from the top end retention sheath 312*a*. In use, when a user wishes to remove the support member 304, the user may remove the seal 322 from retention sheath 312*d* or the seal (not shown) from retention sheath 312*a* to access the support member 304.

Figure 4:
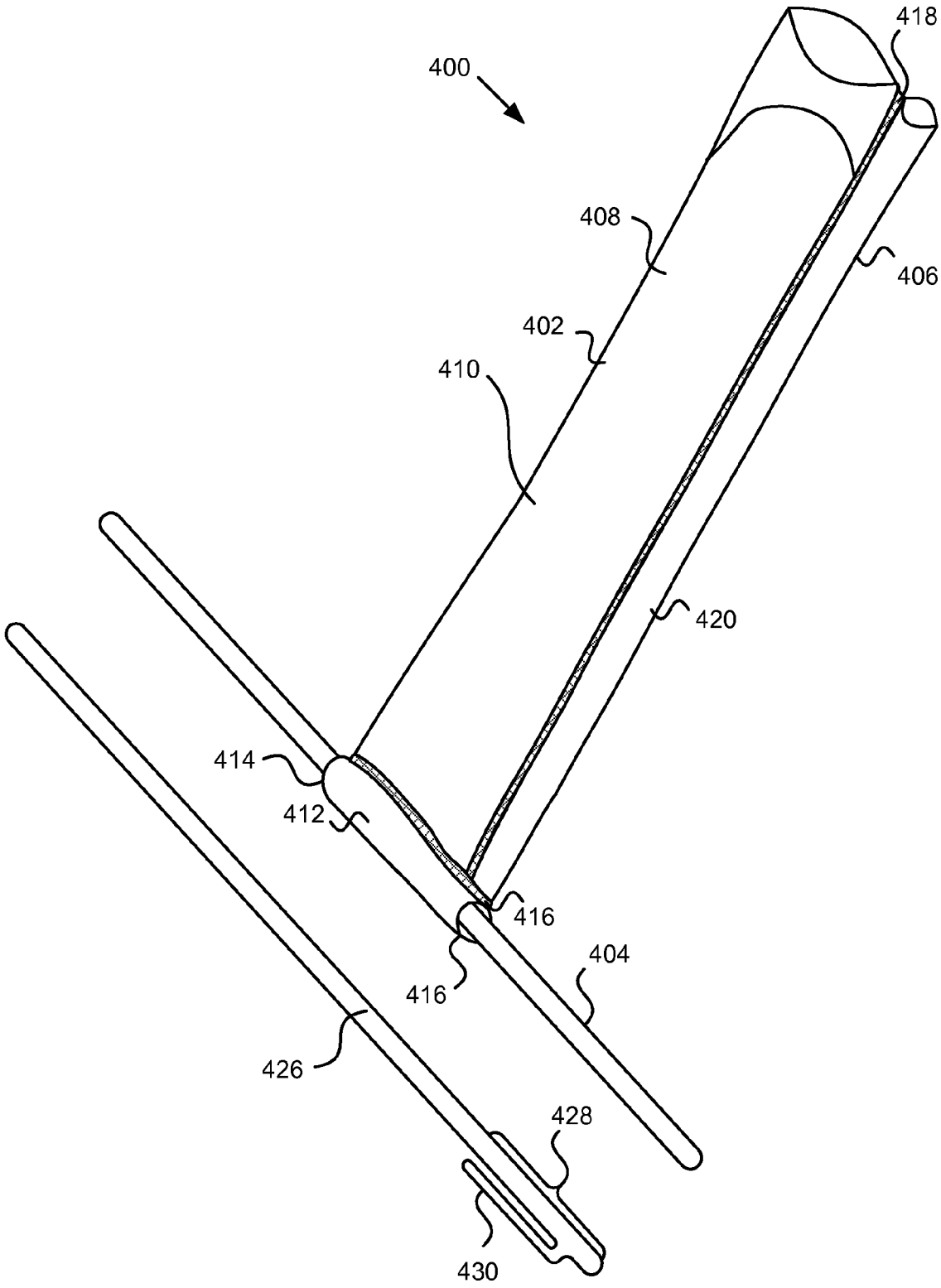
FIG. 4 is a perspective view illustrating one embodiment of a fluid container including a fluid receiving sleeve, a support member coupling, and a rolling sleeve in accordance with the present invention.

FIG. 4 illustrates another embodiment of an apparatus 400 for containing a fluid 408. The apparatus 400 includes a fluid receiving sleeve 402 and a support member coupling 406 which, in the embodiment illustrated in FIG. 4, is a support member receiving sleeve 420. The fluid receiving sleeve 402, support member coupling 406, and the support member receiving sleeve 420 are substantially similar to the fluid receiving sleeve 202, the support member coupling 406 and the support member receiving sleeve 220 discussed above in relation to FIG. 2.

As with the embodiment illustrated in FIG. 2, the support member receiving sleeve 420 may be separated from the fluid receiving sleeve 402 by a liquid tight separating seal 418 on a sidewall 410 of the fluid receiving sleeve 402. The support member receiving sleeve 420 and the fluid receiving sleeve 402 may operate in a manner substantially similar to the operation of the support member receiving sleeve 220 and the fluid receiving sleeve 202 described above in relation to FIG. 2.

In certain embodiments the apparatus 400 may include a rolling sleeve 412 that is perpendicular to the fluid receiving sleeve 402 and the support member receiving sleeve 420. In certain embodiments the rolling sleeve 412 is open at each end 414 and 416. The rolling sleeve 412 is configured to receive a rolling member to assist a user in rolling the fluid receiving sleeve 402 to dispense the fluid 408 contained within the fluid receiving sleeve 402. In certain embodiments the apparatus may include a separate rolling member (not shown) that is received within the rolling sleeve. In the embodiment depicted in FIG. 4 the support member 404 is used as the rolling member to assist the user in rolling the fluid receiving sleeve 402 to dispense the fluid 408 contained within the fluid receiving sleeve 402. One of skill in the art will recognize that in certain embodiments the support member receiving sleeve 420 is coupled to the fluid receiving sleeve 402 and thus, the support member receiving sleeve 420 may also be rolled by the support member 404 once the support member 404 is removed from the support member receiving sleeve 420.

In one embodiment the rolling sleeve 412 is separated from the fluid receiving sleeve 402 and the support member receiving sleeve 420 by a seal 416. The seal 416 may be substantially similar to the seal 216 described in relation to FIG. 2. In embodiments where the fluid contained within the fluid receiving sleeve 402 is liquid, the seal 416 may be liquid tight such that the liquid fluid 408 is retained within the fluid receiving sleeve 402 by the seal 416.

The apparatus 400 depicted in FIG. 4 illustrates an alternative embodiment of a support member 426 that includes a keyed portion 428 configured to engage the rolling sleeve 412 to assist the user in rolling the fluid receiving sleeve 402. The keyed portion includes a tab 430. When the support member 426 is inserted into the rolling sleeve 412, the tab remains outside the rolling sleeve 412. As the support member 426 is rolled, the tab 430 is rotated until the tab 430 contacts the seal 416. Further rotation of the support member 426 causes the tab 430 to engage the fluid receiving sleeve 402 and roll the fluid receiving sleeve 402 around the support member 404. One of skill in the art will recognize that the support member 426 or 404 may incorporate other engagements designed to engage the fluid receiving sleeve 402 without departing from the spirit or essential characteristics of the present invention.

Figure 5A:
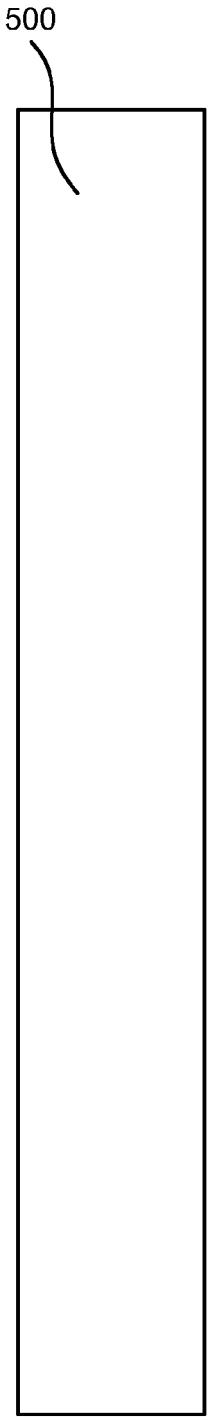
FIG. 5A-5C is a front view illustrating one embodiment of a pattern for creating a fluid container in accordance with the present invention.
Figure 5B:
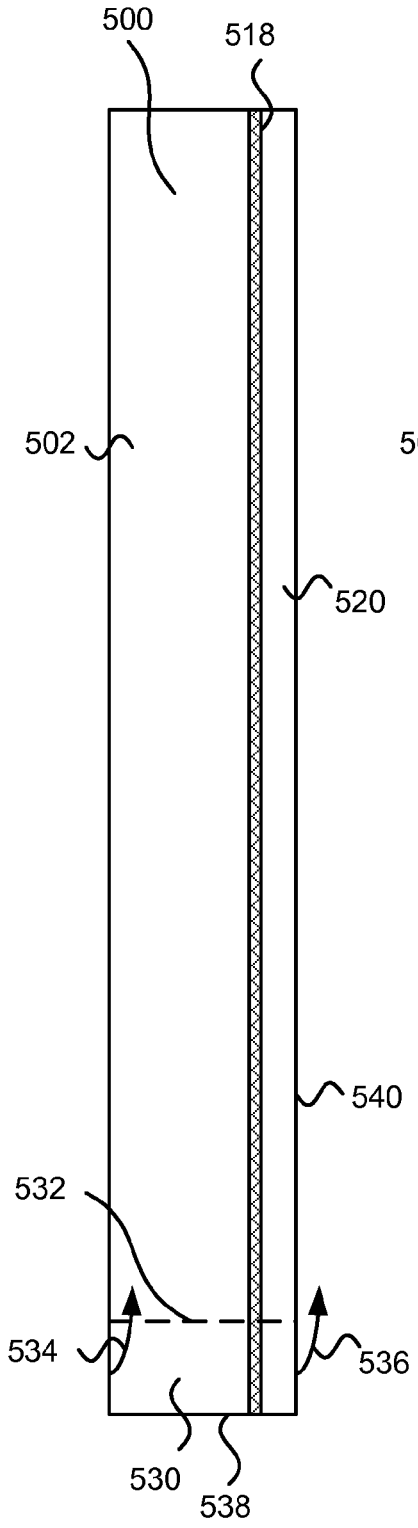
Figure 5C:
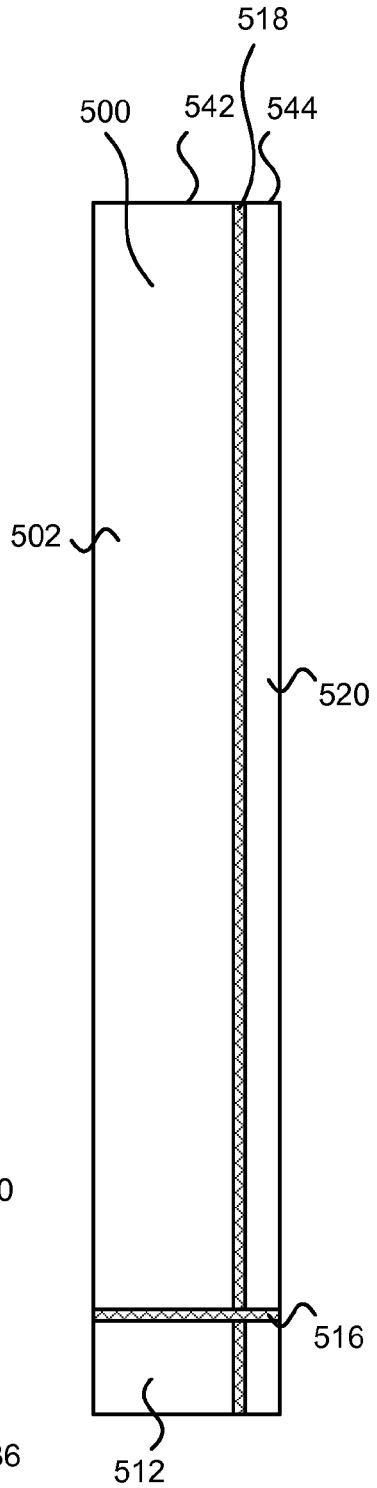

FIGS. 5A through 5C illustrate one embodiment of a method of manufacturing the apparatus 400 for containing a fluid 408. As illustrated, the method may include providing a pliable tube 500 and separating the pliable tube 500 into a plurality of sleeves. In certain embodiments the plurality of sleeves include a fluid receiving sleeve 502, a support member receiving sleeve 520 and a rolling sleeve 512.

In FIG. 5A the fluid receiving sleeve 502 is separated from the support member receiving sleeve 520 by a seal 518. As discussed above, in certain embodiments the seal 518 may be formed through use of glues or other sealing substances injected or inserted into the pliable tube 500. In another embodiment the seal 518 may be formed using plastic welding technology as is know in the art. Examples of plastic welding techniques which may be used to separate the fluid receiving sleeve 502 from the support member receiving sleeve 520 include hot gas welding, speed tip welding, extrusion welding, contact welding, hot plate welding, high frequency welding, ultrasonic welding, vibration friction welding, spin welding, laser welding, solvent welding, or other plastic welding techniques. The seal 518 may be located at a position in the range of about one fourth of an inch to about three fourths of an inch from the side 540 of the pliable tube 500. In certain embodiments, such as where a larger diameter support member is used, the seal 518 may be located at a position further from the side 540 of the pliable tube 500. Of course, in embodiments which include a smaller diameter support member, the seal 518 may be located at a position closer to the side 540 of the pliable tube 500. In certain embodiments the seal 518 may be located in the range of about one fourth of an inch to about three fourths of an inch from either side of the pliable tube 500.

To create the rolling sleeve 512 a flap 530 is folded at line 532 in the direction indicated by arrows 532 and 534. One of skill in the art will recognize that in certain embodiments the line 532 may not actually be physically located on the pliable tube. Rather, line 532 is simply illustrative of a point at which to fold the flap 530. In other embodiments the pliable tube 500 may include a line illustrated thereon to aid in manufacturing the apparatus 400 for containing a fluid 408. The point at which the flap 530 is folded (line 532 as illustrated in FIG. 5B) may be located at a position in the range of about one fourth of an inch to about three fourths of an inch from the bottom 538 of the pliable tube 500. In one embodiment the flap 530 is folded slightly higher than about one fourth of an inch to about three fourths of an inch from the bottom 538 to allow room to seal the rolling sleeve 512 along seal 516. In certain embodiments, such as where a larger diameter support member or rolling member is used, the point at which the flap 530 is folded (line 532 as illustrated in FIG. 5B) may be located at a position further from the bottom 538 of the pliable tube 500. Of course, in embodiments which include a smaller diameter support member or rolling member, the point at which the flap 530 is folded (line 532 as illustrated in FIG. 5B) may be located at a position closer to the bottom 538 of the pliable tube 500.

Once the flap 530 has been folded at the correct position (line 532 as illustrated in FIG. 5B) the rolling sleeve 512 is sealed along seal 516 using a glue or other sealing substance or by any of the plastic welding techniques discussed above.

As discussed above, in certain embodiments, such as the embodiment illustrated in FIG. 2 and discussed above, the rolling sleeve 512 may be omitted from the apparatus for containing a fluid. Thus, in certain embodiments the bottom end 538 may simply be sealed using a glue or other sealing substance or by any of the plastic welding techniques discussed above.

Once the fluid receiving sleeve 502, the support member receiving sleeve 520 and the rolling sleeve 512 have been formed, a fluid such as fluid 408 may be inserted into the fluid receiving sleeve 502. The top end 542 of the fluid receiving sleeve 502 may then be sealed using a glue or other sealing substance or by any of the plastic welding techniques discussed above. In certain embodiments a support member such as support member 404 may be inserted into the support member receiving sleeve 520 and the top end 544 of the support member receiving sleeve 520 may be sealed using a glue or other sealing substance or by any of the plastic welding techniques discussed above. One of skill in the art will recognize that in certain embodiments the same seal may seal both the top end 542 of the fluid receiving sleeve 502 and the top end 544 of the support member receiving sleeve 520.

Figure 6A:
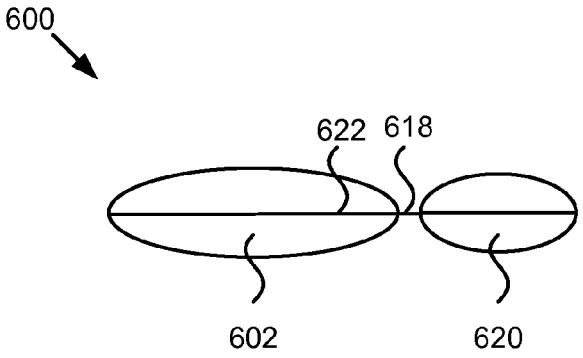
FIG. 6A is a top view further illustrating one embodiment of the fluid receiving sleeve and the support member coupling of FIG. 4 in accordance with the present invention.

FIG. 6A illustrates an end on view of one embodiment of an apparatus 600 for containing a fluid. The embodiment illustrated in FIG. 6A shows the top end of the fluid receiving sleeve 602 and the top end of the support member receiving sleeve 620 having a seal 622. The seal 622 keeps the fluid contained within the fluid receiving sleeve 602. In certain embodiments the seal 622 also keeps the support member contained within the support member receiving sleeve 620. The separating seal 618 separates the fluid receiving sleeve 702 from the support member receiving sleeve 620.

Figure 6B:
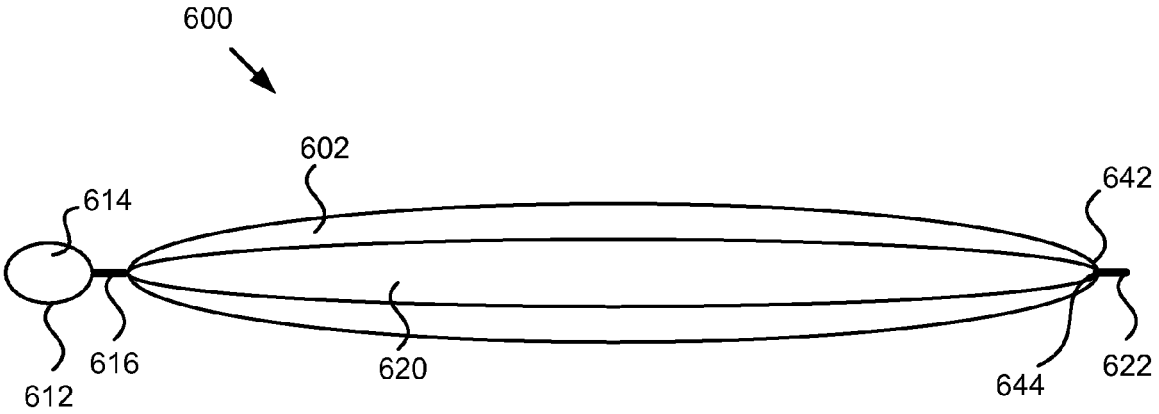
FIG. 6B is a side view further illustrating one embodiment of the fluid receiving sleeve and the rolling sleeve of FIG. 4 in accordance with the present invention.

FIG. 6B illustrates a side view of one embodiment of the apparatus 600 for containing a fluid. The side view of the apparatus 600 illustrated in FIG. 6B shows the rolling sleeve 612 having an open end 614 for receiving a support member or a rolling member. The rolling sleeve is separated from the fluid receiving sleeve 602 and the support member receiving sleeve 620 by seal 616. The top end 642 of the fluid receiving sleeve 602 and the top end 644 of the support member receiving sleeve 620 are sealed by seal 622.

Figure 7:
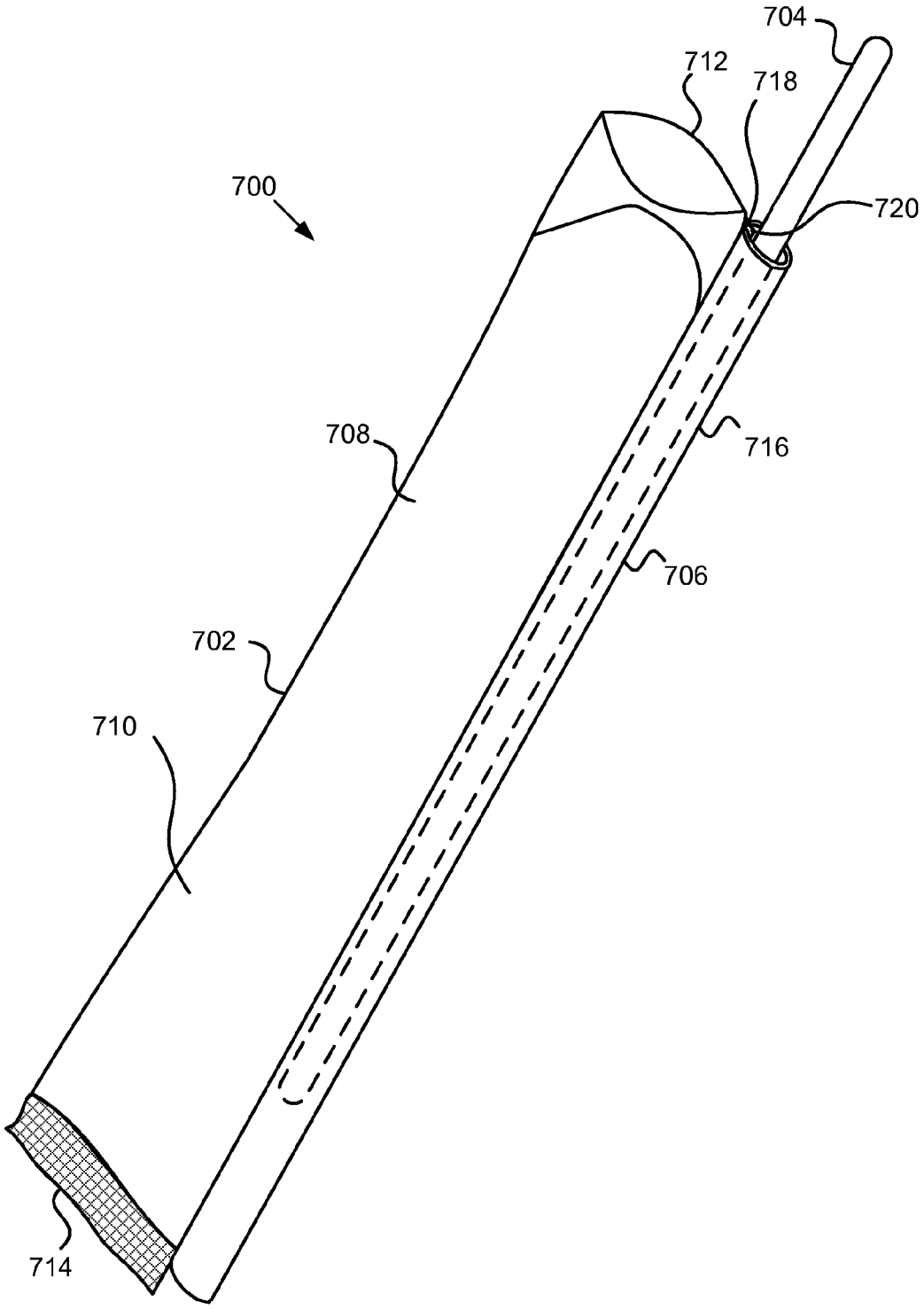
FIG. 7 is a perspective view illustrating one embodiment of a fluid container including a fluid receiving sleeve, a support member, and a support member coupling comprising a hollow tube in accordance with the present invention.

FIG. 7 illustrates another embodiment of an apparatus 700 for containing a fluid 708. The apparatus 800 includes a fluid receiving sleeve 702 and a support member coupling 706 which, in the embodiment illustrated in FIG. 7, is a hollow tube 716 having a length sufficient to span a length between the dispensing end 712 and a sealed end 714 of the fluid receiving sleeve 702. The fluid receiving sleeve 702 is substantially similar to the fluid receiving sleeve 202 discussed above in relation to FIG. 2.

Figure 8A:
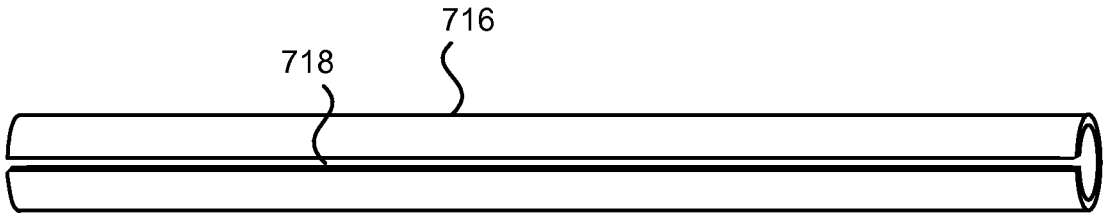
FIG. 8A is a side view further illustrating one embodiment of the hollow tube of FIG. 7 in accordance with the present invention.
Figure 8B:
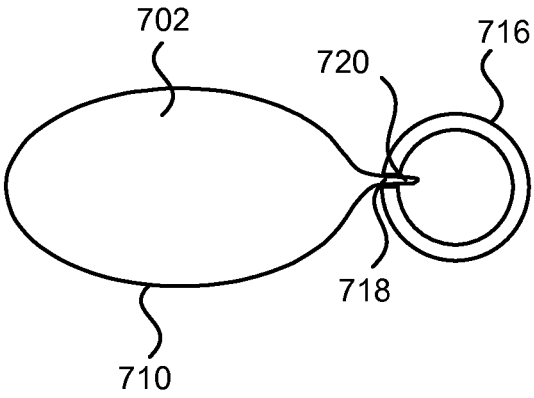
FIG. 8B is a top view further illustrating one embodiment of the hollow tube and the fluid receiving sleeve of FIG. 7 in accordance with the present invention.

The hollow tube 716 of the support member coupling 706 has an inner diameter sufficient to receive the support member 704. As further illustrated in FIGS. 8A and 8B, the hollow tube 716 of the support member coupling 706 is a rigid tube having a slot 718 running along the length of the hollow tube 718. The slot 718 receives a portion 720 of the sidewall 710 of the fluid receiving sleeve 702. The hollow tube 716 of the support member coupling 706 is made of a substantially rigid material having a resiliency sufficient to cause the hollow tube 716 to act as a clamp and retain the portion 720 of the sidewall 710 of the fluid receiving sleeve 702 within the slot 718 on the hollow tube 716. In this fashion the coupling 706 may be used to engage the support member 704 with the fluid receiving sleeve 702 such that the support member supports the fluid receiving tube 702. In certain embodiments the hollow tube 716 may be sufficiently rigid to support the fluid receiving tube 702. Thus, in one embodiment the hollow tube 716 may be the support member.

Figure 9A:
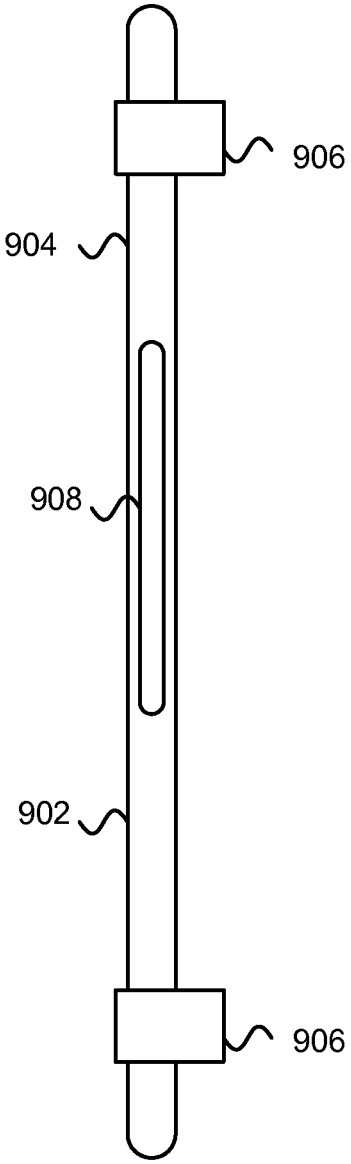
FIG. 9A is a front view illustrating one embodiment of a support member comprising a single use translucent plastic tube containing isolated substances which when combined illuminate through a chemical reaction induced chemiluminescence.
Figure 9B:
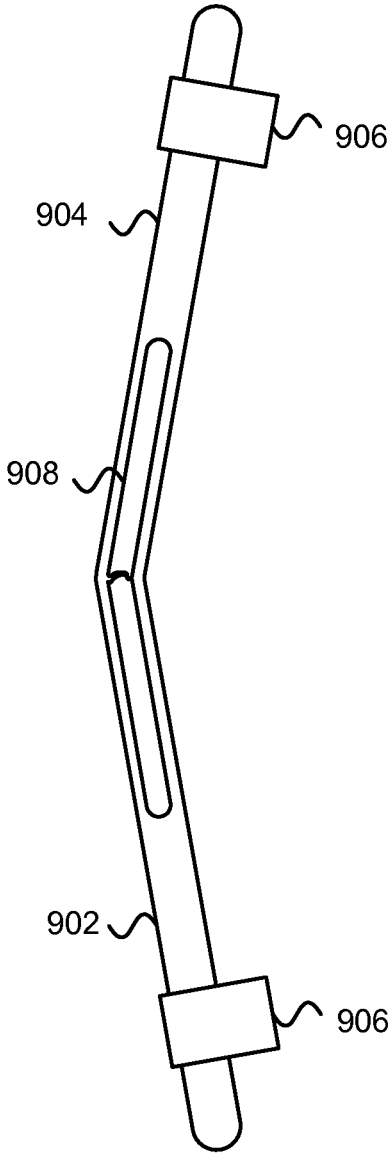
FIG. 9B is front view illustrating one embodiment of the support member of FIG. 9A wherein the isolated substances have been mixed.

FIGS. 9A and 9B illustrate a support member 904 according to one embodiment of the present invention. The embodiments illustrated in FIGS. 9A and 9B are illustrative of a single use translucent plastic tube containing isolated substances which when combined make light through chemiluminescence. Such a device is commonly known as a glow stick. The support member 904, in an exemplary embodiment, includes an outer translucent tube 902, an inner breakable capsule 906. In one embodiment the translucent tube 902 contains hydrogen peroxide and the inner breakable capsule contains a mixture of a fluorescent dye and diphenyl oxalate. When the support member 904 is bent, as illustrated in FIG. 9B, the inner breakable capsule 906 breaks releasing the mixture of fluorescent dye and dephenyl oxalate into the outer translucent tube 902. The mixture of fluorescent dye and dephenyl oxalate with the hydrogen peroxide the ester of the dephenyl oxalate is oxidized yielding two molecules of phenol and one molecule of peroxyacid ester which decomposes to carbon dioxide and releases energy that excites the fluorescent dye. As a result of the excitation and subsequent relaxation of the fluorescent dye, the fluorescent dye releases a photon which illuminates the translucent tube 902.

The fluid contained within the fluid receiving sleeves according to the various embodiments described herein is clear or translucent and allowing light to pass through the fluid. Additionally, in certain embodiments, the pliable material of the fluid receiving sleeves and support member receiving sleeves described herein may also be translucent or clear. Thus, the support member 904, in certain embodiments, may be used to illuminate the neighboring fluid in the fluid receiving sleeve through the clear or translucent pliable material of the fluid receiving sleeve.

FIGS. 9A and 9B also illustrate an alternative embodiment of a support member coupling. In certain embodiments the support member coupling 906 may include a plurality of support member coupling clips 906 attached to the support member 904 and configured to engage the sidewall of the fluid receiving sleeve. FIGS. 9A and 9B depict the support member 904 with two coupling clips 906, one at each end of the support member 904. In certain embodiments additional coupling clips 906 may be attached to the support member 904. In one embodiment a single coupling clip (not shown) may be attached to the support member 904. Where a single coupling clip is used, the single coupling clip should have a length sufficient to support the sidewall of the fluid receiving sleeve. In another embodiment the coupling clips 906 may be attached to the fluid receiving sleeve rather than the support member 904. Of course, one of skill in the art will recognize that in embodiments where the support member coupling is a support member receiving sleeve, or a plurality of retention sheaths, the coupling clips 906 may be unnecessary to engage the support member 904 with the fluid receiving sleeve and the coupling clips 906 may therefore be omitted.

Figure 10:
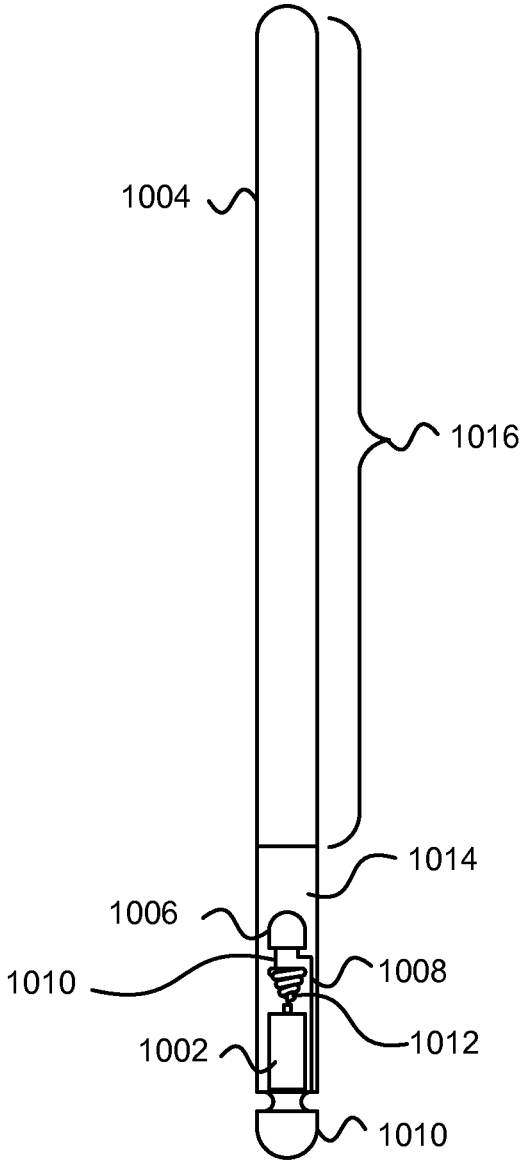
FIG. 10 is a front view illustrating one embodiment of a support member having a power source electrically coupled to a light emitting diode for illuminating the support member.

FIG. 10 illustrate another embodiment of a support member 1004 having an illumination source according to the present invention. In certain embodiments the support member 1004 includes an electrical components compartment 1014 and an illumination portion 1016.

The electrical components compartment 1014 houses the electrical components necessary to illuminate the illumination portion 1016 of the support member 1004. In certain embodiments the electrical components of the support member include a light emitting diode 1006 and a power source 1002. The power source 1002 may be any standard electrical battery as is known in the art. The light emitting diode 1006 is electrically coupled to the power source 1002 by two leads 1008 and 1010. In certain embodiments the support member 1004 also includes a push button electrical switch 1010 to turn on and off the light emitting diode 1006. One of skill in the art will recognize other types of switches may be used in place of the push button electrical switch 1010. In certain embodiments the support member includes a spring 1012. The spring 1012 maintains contact with the power source 1002 when the support member 1004 is moved such that the electrical connection between the power source 1002 and the light emitting diode 1006 is not lost.

The illumination portion 1016 of the support member 1004 may include a clear or translucent material that allows light to pass through the illumination portion 1016. In certain embodiments the illumination portion 1016 may be colored such that the light passing through the translucent material of the illumination portion 1016 is altered. In another embodiment the illumination portion 1012 may be white or clear and different colored light emitting diodes 1006 may be used to illuminate the illumination portion 1016 of the support member 1004 in a particular color.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to contain a fluid, the apparatus comprising:

a fluid receiving sleeve comprising a pliable material having a structural integrity that may be overcome by a weight of a fluid when the fluid is disposed within the fluid receiving sleeve, the fluid receiving sleeve comprising a sidewall having a dispensing end and a sealed end, wherein the sidewall has a length greater than the lengths of the dispensing end and the sealed end, the dispensing end and the sealed end each having substantially the same length such that the fluid receiving sleeve is substantially rectangular;

a support member comprising a substantially rigid rod comprising a material having a structural integrity sufficient to support the pliable material of the fluid receiving sleeve when the fluid is disposed within the fluid receiving sleeve, the support member external to the fluid when the fluid is disposed within the fluid receiving sleeve; and a support member coupling configured to couple the support member to the fluid receiving sleeve when the support member is coupled to the support member coupling, the support member coupling positioned along a vertical edge of the sidewall of the rectangular fluid receiving sleeve forming a support member receiving sleeve, wherein the support member supports the fluid receiving sleeve when the support member is within the support member receiving sleeve without being coupled to a support structure external to the fluid receiving sleeve, wherein the apparatus is sized to be hand-held when a fluid is contained within the fluid receiving sleeve, wherein the support member in the support member receiving sleeve comprises the sole vertical support for the fluid receiving sleeve and wherein the fluid receiving sleeve and the support member receiving sleeve are formed with a single bond between the fluid receiving sleeve and supporting member to form a separating seal without additional vertically oriented bonds.

2. The apparatus of claim 1, wherein the rigid rod can be removed from the support member receiving sleeve.

3. The apparatus of claim 1, wherein the fluid receiving sleeve comprises a sidewall with the separating seal, a dispensing end, and a sealed end that, comprise a liquid tight seal such that a fluid dispensed within the fluid receiving sleeve is retained within the fluid receiving sleeve, wherein the support member receiving sleeve comprises a support member sidewall attached to the sidewall of the fluid receiving sleeve along substantially an entire length of the sidewall of the fluid receiving sleeve at the separating seal.

4. The apparatus of claim 1, further comprising a rolling sleeve disposed perpendicular to the fluid receiving sleeve and configured to couple a rolling member to the fluid receiving sleeve, wherein the rolling member assists a user in rolling the fluid receiving sleeve to dispense a fluid disposed within the fluid receiving sleeve.

5. The apparatus of claim 4, wherein the support member removed from the support member coupling comprises the rolling member.

6. The apparatus of claim 1, further comprising a translucent fluid disposed within the fluid receiving sleeve, wherein the support member is configured to illuminate the translucent fluid disposed within the fluid receiving sleeve.

7. The apparatus of claim 6, wherein the support member comprises a single use translucent plastic tube containing isolated substances which when combined illuminate through a chemical reaction induced chemiluminescence such that the support member illuminates the translucent fluid disposed within the fluid receiving sleeve.

8. The apparatus of claim 6, wherein the support member comprises a power source and a light emitting diode, wherein the power source is electronically coupled to the light emitting diode, wherein the light emitting diode is configured to illuminate the support member.

9. The apparatus of claim 1, wherein the single sheet of the pliable material is sealed along the dispensing end of the fluid receiving sleeve, between the fluid receiving sleeve and the support member receiving sleeve, and along the sealed end, wherein the fluid receiving sleeve and the support member receiving sleeve are free from other sealed locations.

10. The apparatus of claim 9, wherein the support member receiving sleeve is further sealed at the bottom of the support member receiving sleeve adjacent to the sealed end of the fluid receiving sleeve.

11. An apparatus to contain a fluid, the apparatus comprising:

a pliable tube separated into a plurality of sleeves, the plurality of sleeves comprising;

a fluid receiving sleeve comprising a pliable material having a structural integrity that may be overcome by a weight of a fluid when the fluid is disposed within the fluid receiving sleeve, the fluid receiving sleeve comprising a sidewall having a dispensing end and a sealed end, wherein the sidewall has a length greater than the lengths of the dispensing end and the sealed end, the dispensing end and the sealed end each having substantially the same length such that the fluid receiving sleeve is substantially rectangular; and a support member receiving sleeve configured to couple a support member to the fluid receiving sleeve when the support member is coupled to the support member receiving sleeve without being coupled to a support structure external to the fluid receiving sleeve, the support member receiving sleeve positioned along a vertical edge of the sidewall of the rectangular fluid receiving sleeve; and a support member comprising a substantially rigid rod disposed in the support member receiving sleeve, the rigid rod comprising a material having a structural integrity sufficient to support the pliable material of the fluid receiving sleeve when the fluid is disposed within the fluid receiving sleeve, the support member external to the fluid when the fluid is disposed within the fluid receiving sleeve;

wherein the apparatus is sized to be hand-held when a fluid is contained within the fluid receiving sleeve, and wherein the support member in the support member receiving sleeve comprises the sole vertical support for the fluid receiving sleeve and wherein the fluid receiving sleeve and the support member receiving sleeve are formed with a single bond between the fluid receiving sleeve and supporting member to form a separating seal without additional vertically oriented bonds.

12. The apparatus of claim 11, further comprising a rolling sleeve disposed perpendicular to the fluid receiving sleeve and the support member receiving sleeve, the rolling sleeve configured to couple a rolling member to the fluid receiving sleeve, wherein the rolling member assists a user in rolling the fluid receiving sleeve to dispense a fluid disposed within the fluid receiving sleeve.

13. The apparatus of claim 12, wherein the support member removed from the support member receiving sleeve comprises the rolling member.

14. The apparatus of claim 11, further comprising a translucent fluid disposed within the fluid receiving sleeve, wherein the support member is configured to illuminate the translucent fluid disposed.

15. The apparatus of claim 14, wherein the support member comprises a single use translucent plastic tube containing isolated substances which when combined illuminate through a chemical reaction induced chemiluminescence such that the support member illuminates the translucent fluid disposed within the fluid receiving sleeve.

16. The apparatus of claim 11, wherein the single sheet of the pliable material is sealed along the dispensing end of the fluid receiving sleeve, between the fluid receiving sleeve and the support member receiving sleeve, along the sealed end, and a bottom of the support member receiving sleeve adjacent to the sealed end, wherein the single sheet of the pliable material is free from other sealed locations.

17. The apparatus of claim 16, wherein the support member receiving sleeve is further sealed at the bottom of the support member receiving sleeve adjacent to the sealed end of the fluid receiving sleeve.

18. An apparatus to contain a fluid, the apparatus comprising:

a pliable tube separated into a plurality of sleeves, the plurality of sleeves comprising;

a fluid receiving sleeve comprising a pliable material having a structural integrity that may be overcome by a weight of a fluid when the fluid is disposed within the fluid receiving sleeve, the fluid receiving sleeve comprising a sidewall with a separating seal, a dispensing end, and a sealed end that comprise a liquid tight seal such that a fluid dispensed within the fluid receiving sleeve is retained within the fluid receiving sleeve, and wherein the sidewall has a length greater than the lengths of the dispensing end and the sealed end, the dispensing end and the sealed end each having substantially the same length such that the fluid receiving sleeve is substantially rectangular;

a single support member receiving sleeve positioned along a vertical edge of the sidewall of the rectangular fluid receiving sleeve and external to the fluid receiving sleeve, wherein the support member receiving sleeve is attached to the sidewall of the fluid receiving sleeve and separated from the fluid receiving sleeve by a liquid tight seal, and a support member comprising a substantially rigid rod comprising a material having a structural integrity sufficient to support the pliable material of the fluid receiving sleeve when the fluid is disposed within the fluid receiving sleeve, the support member receiving sleeve configured to couple the support member comprising a substantially rigid rod to the fluid receiving sleeve when the support member is coupled to the support member receiving sleeve without being coupled to a support structure external to the fluid receiving sleeve wherein the support member in the support member receiving sleeve comprises the sole vertical support for the fluid receiving sleeve, and wherein the fluid receiving sleeve and the support member receiving sleeve are formed with a single liquid tight seal between the dispensing end and the sealed end without additional vertically oriented bonds, wherein the fluid receiving sleeve and the support member receiving sleeve are sealed along the dispensing end of the fluid receiving sleeve, between the fluid receiving sleeve and the support member receiving sleeve, along the sealed end, and along a bottom of the support receiving sleeve adjacent to the sealed end; and a translucent liquid disposed within the fluid receiving sleeve, wherein the support member is configured to illuminate the translucent fluid disposed within the fluid receiving sleeve, the support member comprising separated substances that illuminate the support member through a chemical reaction induced chemiluminescense when a separation between the substances is breached, wherein the apparatus is sized to be hand-held when a fluid is contained within the fluid receiving sleeve.

19. The apparatus of claim 18, wherein the rigid rod can be removed from the support member receiving sleeve.

20. The apparatus of claim 18, wherein the support member comprises a single use translucent plastic tube containing isolated substances which when combined illuminate through the chemical reaction induced chemiluminescence.

* * * * *